US007610693B2

(12) United States Patent
Burgess et al.

(10) Patent No.: US 7,610,693 B2
(45) Date of Patent: Nov. 3, 2009

(54) TUMBLE DRYER DISPENSER

(75) Inventors: Karl Burgess, Wirral (GB); David Jones, Wirral (GB); Claire Louise Robins, Hoole (GB)

(73) Assignee: The Sun Products Corporation, Wilton, CT (US)

( * ) Notice: Subject to any disclaimer, the term of this patent is extended or adjusted under 35 U.S.C. 154(b) by 1107 days.

(21) Appl. No.: 10/690,116

(22) Filed: Oct. 21, 2003

(65) Prior Publication Data

US 2004/0118014 A1 Jun. 24, 2004

(30) Foreign Application Priority Data

Oct. 23, 2002 (GB) ..... 0224660.1
Dec. 13, 2002 (GB) ..... 0229067.4

(51) Int. Cl.
*F26B 11/02* (2006.01)

(52) U.S. Cl. ..... 34/597

(58) Field of Classification Search ..... 34/597
See application file for complete search history.

(56) References Cited

U.S. PATENT DOCUMENTS

| | | | | |
|---|---|---|---|---|
| 3,634,947 | A * | 1/1972 | Furgal | 34/60 |
| 3,701,202 | A * | 10/1972 | Compa et al. | 34/72 |
| 4,297,406 | A | 10/1981 | Metcalfe et al. | 428/215 |
| 4,642,908 | A * | 2/1987 | Brenner | 34/60 |
| 5,072,526 | A * | 12/1991 | Hirota et al. | 34/60 |
| 5,176,297 | A * | 1/1993 | Mooney et al. | 222/325 |
| 5,791,801 | A * | 8/1998 | Miller | 401/132 |

FOREIGN PATENT DOCUMENTS

| | | |
|---|---|---|
| CA | 1 005 204 | 2/1977 |
| EP | 328 863 | 8/1989 |
| EP | 361 593 | 4/1994 |
| GB | 1 546 763 | 5/1979 |
| GB | 2 066 309 | 7/1981 |
| GB | 2 072 533 | 10/1981 |
| WO | 02/33160 | 4/2002 |
| WO | 02/33161 | 4/2002 |

OTHER PUBLICATIONS

PCT International Search Report in a PCT application PCT/EP 03/10942.
Derwent Abstract of EP 328 863 published Aug. 23, 1989.
GB Search Report in a GB application GB 0229067.4, Date of Search Apr. 29, 2003.
GB Search Report in a GB application GB 0224660.1, Date of Search Mar. 12, 2003.

* cited by examiner

*Primary Examiner*—Jiping Lu
(74) *Attorney, Agent, or Firm*—Sterne, Kessler, Goldstein & Fox PLLC

(57) ABSTRACT

A device for treating fabrics in a tumble dryer comprising a reservoir for storing a fabric treatment composition and transfer device to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterised in that the transfer device comprises compressed foam.

16 Claims, 5 Drawing Sheets

TUMBLE DRYER DISPENSER

BACKGROUND OF THE INVENTION

1. Field of the Invention

The present invention relates to a device for treating fabrics inside a tumble dryer, particularly a device which is reusable.

2. The Related Art

In the treatment of fabrics in a tumble dryer it is known to add one or more conditioning agents. For instance, for imparting a softening benefit to fabrics it is known from CA 1,005,204 to co-mingle fabrics in a tumble dryer with a flexible substrate carrying a normally solid fabric conditioning agent. The co-mingling of the fabrics with impregnated substrates requires the separation of the substrate from the fabrics after the completion of the tumble dryer treatment. Especially in using flexible substrates, this separation is often time-consuming in that the substrates cannot readily be located. Other disadvantages of such products include uneven product distribution following entanglement of the substrate with fabrics which can lead to greasy marks on fabrics (staining) and the tendency of such substrates to become positioned over the tumble dryer vent, thus giving virtually no benefit to the fabrics during a tumble drying cycle. Furthermore, these products are designed for single use only and therefore need to be replaced after every cycle.

For overcoming these problems it has been suggested, for instance in GB 2,066,309 and U.S. Pat. No. 3,634,947, to use conditioner dispensing articles, comprising means for attachment of the substrate to the tumble dryer wall. Other proposals, such as for instance disclosed in GB 1,399,728 involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

It is an object of the present invention to provide an improved device suitable for treatment fabrics in a tumble dryer. It is also an object to provide a device with improved delivery of the fabric treatment composition and reduced staining.

SUMMARY OF THE INVENTION

According to the present invention, there is provided a device for treating fabrics in a tumble dryer comprising: a reservoir for storing a fabric treatment composition and transfer means to expose the fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterised in that the transfer means comprises compressed foam.

With this arrangement, the foam takes less time to charge (fill up) with composition, and so is effective more quickly after initial installation.

Also, with this arrangement, the foam is stiffened. Stiffening the foam reduces staining which would otherwise result from compression of the foam (and consequential over dosing of the composition) during the tumble drying cycle (as the rotating fabrics impact the foam). Foam compression also reduces the size of the pores within the foam and this enhances the transfer (by capillary action) of fluid composition to the whole foam surface via such pores, by improved capillarity. Otherwise, the fluid can flow under gravity to the lowermost portion/s of the foam and present excessive amounts on the surface, leading to staining.

The compressed foam may be in the form of one or more layers. Preferably the foam layer is compressed prior to fitting in the device. Compression may be by any suitable process, and may use a combination of heat and pressure so as to effect a permanent compression of the foam.

Preferably the compressed foam is a polyurethane foam and further preferably it is a polyester foam.

Preferably the foam has a compression ratio of 8 or more, i.e. it has been compressed to ⅛ or less than its original thickness.

However, other ratios such as 10, 12, 14 may be used.

The initial (pre-compression) pore size of the foam may be 120 microns or less, preferably 100 or less, further preferably 90 or less, further preferably 80 or less and further preferably 60 or less. Particularly preferred pore sizes are 80 and 60.

Pore size here refers to pores per linear inch or PPI, and can be measured in a number of ways, e.g. by optical microscope.

The transfer means may comprise at least one outer layer of compressed foam and at least one inner flow control member. The latter may be a membrane selected for its fine/precise flow control capability.

Fine/precise flow control materials are often physically delicate, and so with this arrangement, a precise but delicate flow control member can be used for precise dosing of fabric treatment composition, the inner flow control member/s protected by the compressed foam (due to its rigidity).

The transfer means may form part of the reservoir which may be removable from (for replacement or refilling) or integral with a body portion of the device.

The inner flow control member(s) may, for example, comprise a membrane, or a layer of e.g. semi permeable material/s e.g. polyester, polypropylene, and include Goretex and Accurel or the like or a woven/non-woven membrane which may be, but is not intended to be restricted to a thin skin.

The device may comprise a support member to which the reservoir is attachable, the support member including one or more suction cups for attachment of the support member to the tumble dryer interior, and preferably the door, wherein the suction cup/s have one or more respective suction cup actuators.

With this arrangement, the reservoir does not restrict access to the suction cup. Force can therefore be applied directly to the suction cup actuator which allows for more effective suction and consequently more effective attachment of the support member to the tumble dryer interior.

A further advantage is that attachment of the support member need not necessitate excessive pressure being exerted on the reservoir which could then leak.

The suction cup and actuator may be moveable relative to e.g. resiliently mounted on the support member. An advantage of this is that force can be applied to the suction cup actuator without restriction on such movement by the structure/rigidity of support member.

There may be one or more suction cups mounted substantially centrally on the support member. This gives the advantage of a central point of attachment to the dryer interior, providing optimum stability of the device.

The suction cup may have a smoothly curved outer perimeter, e.g. circular or oval.

The suction cup may occupy approximately from 30% to 90%, and preferably 40% to 60% of the total area of the support member. In one embodiment, the suction cup occupies 50% of the total area.

The device may be sized to allow manual installation using one hand. Accordingly the device may have an average diameter equivalent to an average hand span, e.g. 14 cm or less, and preferably 12 cm or less. In one embodiment the device has an average diameter of approximately 11 cm.

The reservoir for storing fabric treatment composition may be attachable to said support member so as to lock into position. Accordingly the reservoir and support member may have corresponding inter-engagement members.

The inter-engagement members may comprise one or more pairs of projections or one or more pair projections and apertures on corresponding respective portions of the reservoir and support member which are configured for snap-fit engagement.

By the term aperture, it is intended to mean any formation suitable for receipt of a projection, and accordingly this term includes but is not limited to: slots, recesses, through-holes.

The inter-engagement members may include resilient portions to facilitate engagement. For example, the one or more projections may include respective resilient hinge portions to allow flexing of each projection during engagement with a corresponding aperture.

Alternatively or additionally, the aperture may include resilient portions to facilitate engagement.

The one or more projections and/or apertures may include locking features to facilitate or improve snap-fit engagement. For example one or more projections may include one or more lugs which lock the projection/s into the respective aperture/s. The one or more lugs may be inclined to facilitate smooth engagement.

The one or more projections may be biased toward a locking position with a respective aperture/projection, whereby relative resilience of the projection and or aperture and or device itself allows movement of the projection for engagement/disengagement.

Further attachment members may be provided on the support member, to enhance attachment where reduced suction may result e.g. from a pitted surface (as can be found on condenser dryers).

The reservoir may be housed in a body portion and removable therefrom. The transfer means may be on the body, located for fluid connection (by a channel or duct) with the reservoir (when installed). Preferably the reservoir is engageable with the body, e.g. the channel or duct as mentioned above, by a snap-fit connection or interference fit connection, so as to prevent leakage when installed. To this end the body may comprise resilient portions/components (such as the channel or duct) for elastic engagement with the reservoir for a leak-proof fit.

The fluid connection preferably includes an inlet port or channel for receiving a predetermined amount of the composition from the reservoir sufficient for a predetermined number of cycles at a given temperature, time and load size and may further include a charging port or channel or recess situated directly behind the membrane for continuous feed or charging of the flow control members.

The transfer of fabric treatment composition to the fabrics in the tumble drier may be effected solely by airflow generated in the tumble drier. Depending upon the model of the tumble drier and program setting temperatures of up to 100° C. with wet clothes may be generated within the tumble drier, generally in the range 30° C. to 80° C. for most drying cycles (the hot air generated by the heater in the tumble drier may be as high as 150° C., generally 110° C. to 120° C.).

In addition, the transfer may be constructed and arranged such that there may be direct contact between fabric in the tumble drier and the exposed fabric treatment composition in order to facilitate transfer of fabric treatment composition to the fabric.

Preferably the exterior surface of the compressed foam and the reservoir is smooth. In one embodiment the external profile of the installed device is generally hemispherical.

The reservoir may hold sufficient fabric composition for any number of drying cycles and for instance the reservoir may hold sufficient composition for a single cycle. With this arrangement, different compositions could be used for different drying cycles allowing great flexibility for the user.

The reservoir of the device of the invention may alternatively or additionally be capable of holding sufficient fabric treatment composition for a plurality of drying cycles of the tumble drier. In this case, the reservoir preferably holds sufficient composition for at least six, preferably at least ten drying cycles, more preferably at least twenty cycles, of the tumble drier. The device may comprise means for dispensing a unit dose of fabric composition from the reservoir at or before the start of the drying cycle which is sufficient to provide the required amount of fabric treatment composition during the drying cycle. The reservoir may be divided into a plurality of cavities or compartments each containing fabric composition, the contents of each cavity may be sequentially transferred to the transfer means.

The reservoir may include means for indicating to the user when the fabric treatment composition is used up, preferably comprising visible indicia. This may be effected by a transparent or translucent reservoir (or portion/s of). There may be at least one opening of the reservoir to view the composition therein. The fabric treatment composition may be impregnated in a solid substrate which gives an appearance change, for example changes colour, when all the fabric treatment composition has been used up.

The device according to the invention may comprise a reservoir which is designed to be replaced when the fabric treatment composition is used up. For example, the reservoir may be provided in the form of a disposable plastic container e.g. bottle, carton or collapsible pouch which may have a peelable lid.

Alternatively, the reservoir may be designed to be recharged with a new fabric treatment composition when required. In this case the reservoir has an openable portion for charging and, if necessary, discharging the fabric treatment composition. For example, the reservoir may be provided in the form of an openable compartment into which may be placed a block or semi-permeable sachet of fabric treatment composition. Suitable materials for the reservoir include polypropylene.

The fabric treatment composition may be in the form of a liquid, solid or gel. Where a solid or gel is used, this may be liquid at operating temperatures of the dryer. The composition preferably comprises at least a perfume component and optionally water and may also comprise one or more perfume solubilisers. In this way the composition can act as a freshening composition.

In addition, according to a further aspect of the invention there is provided a kit for the treatment of fabrics in a tumble drying cycle, comprising the combination of the device of the first or second aspect of the invention, together with a fabric treatment composition which may contained in a reservoir suitable for use with said device.

Instructions for use of the device, including installation/refilling of said reservoir may be included.

In addition, according to the invention there is provided a method of treating fabrics in a tumble dryer during multiple tumble drying cycles comprising attaching a device according to the invention to the inside of a tumble dryer door and carrying out a tumble drying process with fabrics inside the tumble dryer.

Further provided in accordance with the invention is a tumble dryer with a device according to the invention attached therein.

BRIEF DESCRIPTION OF THE DRAWING

Various non-limiting embodiments of the invention will now be more particularly described with reference to the following figures in which.

DETAILED DESCRIPTION OF THE INVENTION

Figure 1:
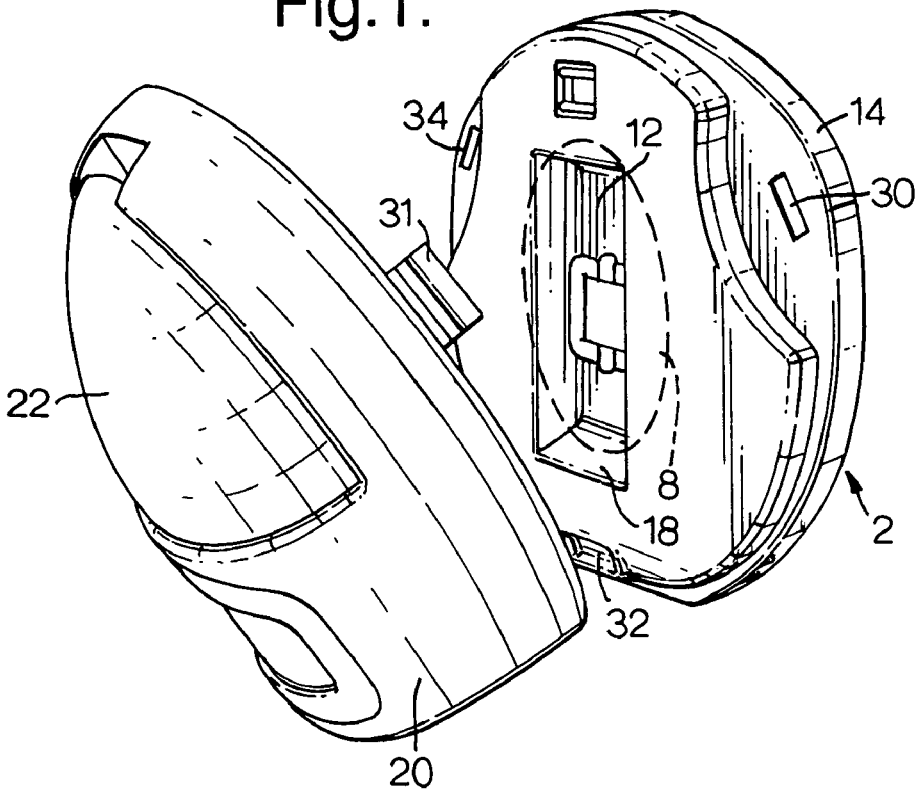
FIG. 1 is a schematic perspective view of a first embodiment according to one aspect of the invention.

Similar reference numbers are used throughout the figures to identify common features.

Referring to the drawings, there is illustrated a device 1 (shown orientated upright and viewed in perspective) for treating fabrics in a tumble dryer (not shown) during multiple tumble drying cycles, the device comprising a support member 2 and a reservoir 6 for storing fabric treatment composition attachable to said support member 2, the support member 2 including a suction cup 8 for attachment of the support member 2 to the tumble dryer interior, and preferably the door, wherein the suction cup 2 has a respective suction cup actuator 10.

The support member 2 is a generally circular element with a peripheral skirt 14.

The suction cup 8 and rigid actuator 10 are fixed together and resiliently mounted centrally on the support member by means of a flexible bridge 12. The bridge 12 is supported by two inclined legs 16, 18. The flexibility of the bridge 12 allows force to be applied to the suction cup actuator 10 without restriction on such movement by the skirt 14. Whilst the legs are sufficiently stiff and the skirt 14 dimensioned to abut the surface of the interior of the dryer, so as to restrict movement of the support member 2 once attached.

The suction cup 8 has a radius of 3.6 cm and (when viewed in plan view) occupies 50% of the total area of the support member 2 which has a radius of 5.4 cm (however the radius of the member 2 progressively increases to 5.8 cm at three points which will be described in more detail below).

The device 1 is sized to allow manual installation using one hand.

The reservoir 6 comprises a rigid dome shaped body 20 housing a reservoir bottle 22 configured for snap-fit engagement in a recess (not shown) of body 20. The reservoir recess constitutes a major part of the upper half of the body 20 (when orientated upright).

The reservoir 6 is attachable to the support member 2 so as to lock into position. Accordingly the reservoir 6 and support member have corresponding inter-engagement members 30,31,32,33,34,35.

The inter-engagement members comprise three pairs of projections 31,33,35 and apertures 30,32,34 on corresponding respective outer portions 31*a*,33*a*,35*a* of the reservoir body 20 and outer portions 30*a*,32*a*,36*a* of the skirt 14 of the support member 2 which are configured for snap-fit engagement.

The inter-engagement members 30,31,32,33,34,35 are resiliently mounted or include resilient portions to facilitate engagement. The projections 31,33,35 flex by means of limited radial resilience of skirt 14 upon which they are mounted.

Figure 2:
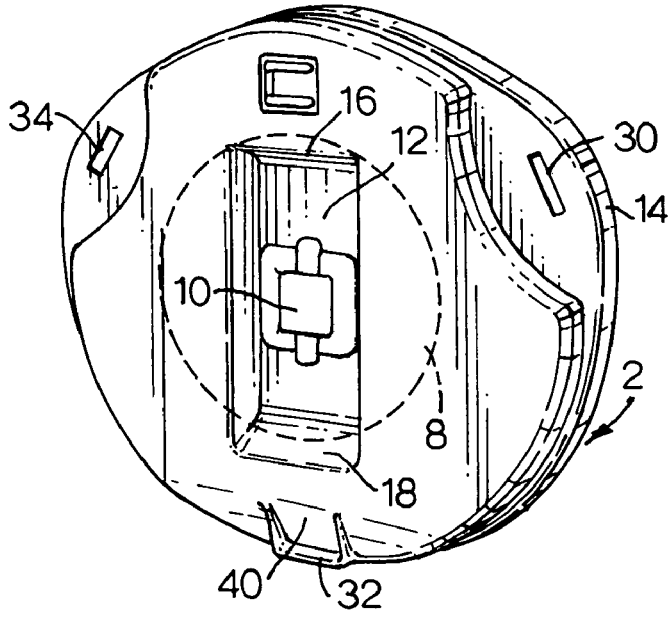
FIG. 2 is a further view of the support member (back plate) of the device of FIG. 1.
Figure 3:
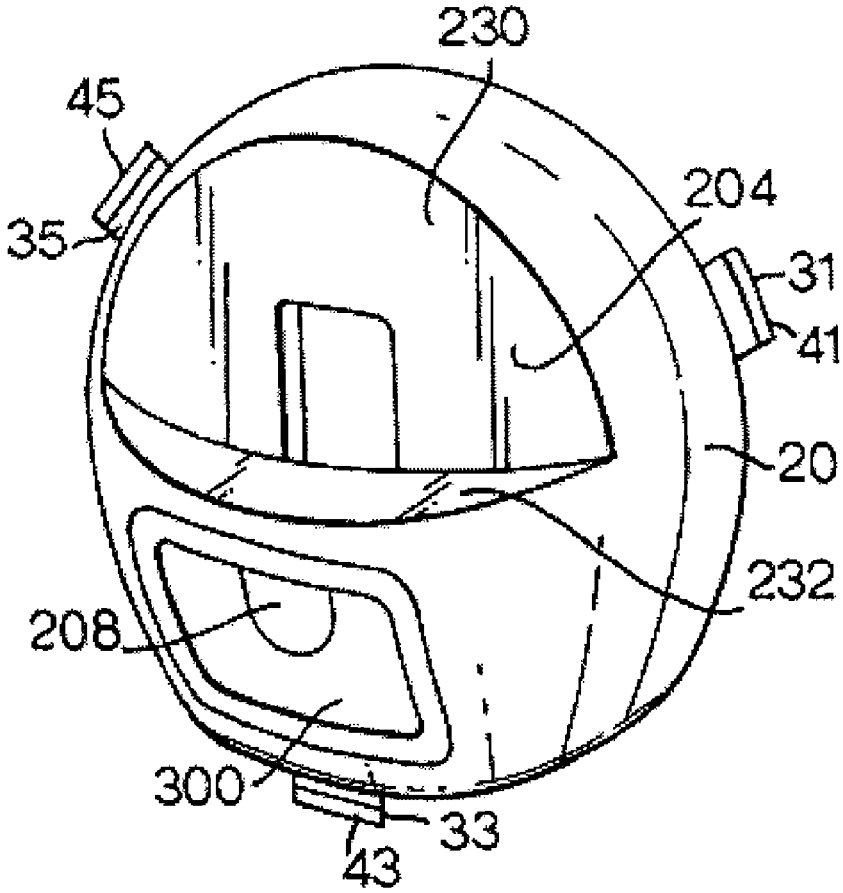
FIG. 3 is a schematic perspective view of the reservoir of FIG. 1.
Figure 4A:
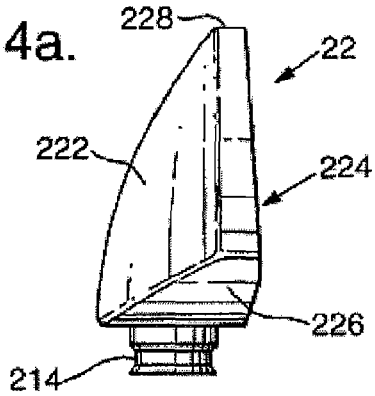
FIGS. 4*a*-4*g* are different views of the reservoir bottle of FIG. 1.
Figure 4B:
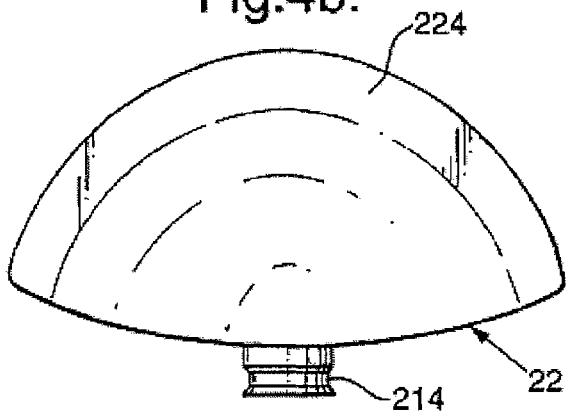
Figure 4C:
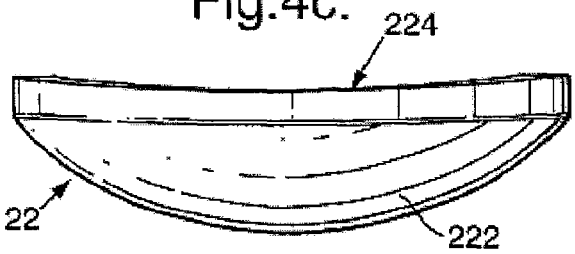
Figure 4D:
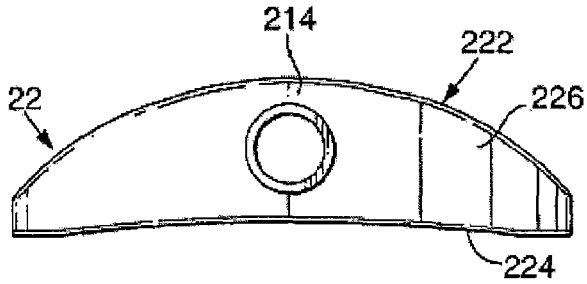
Figure 4E:
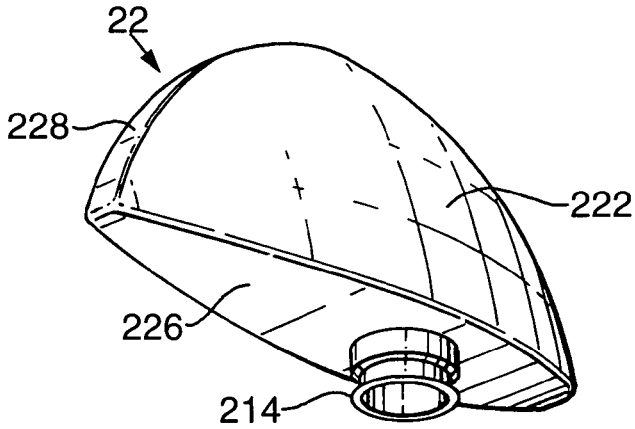
Figure 4F:
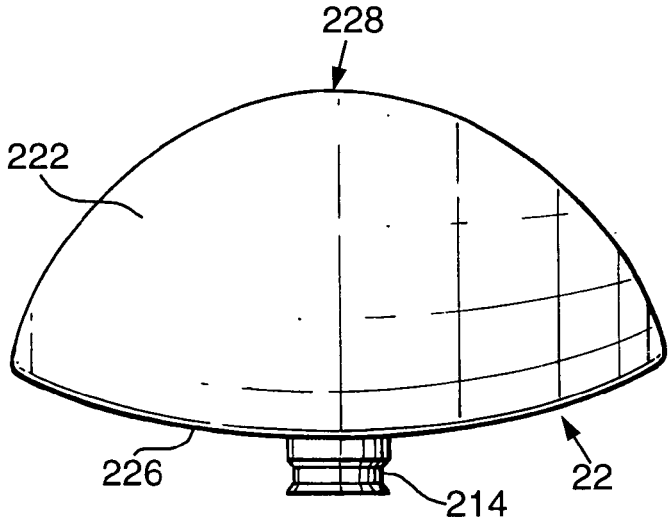
Figure 4G:
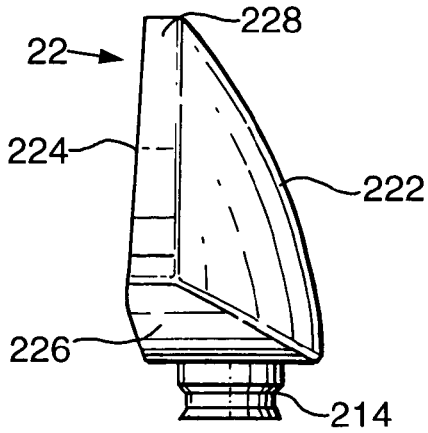
Figure 5:
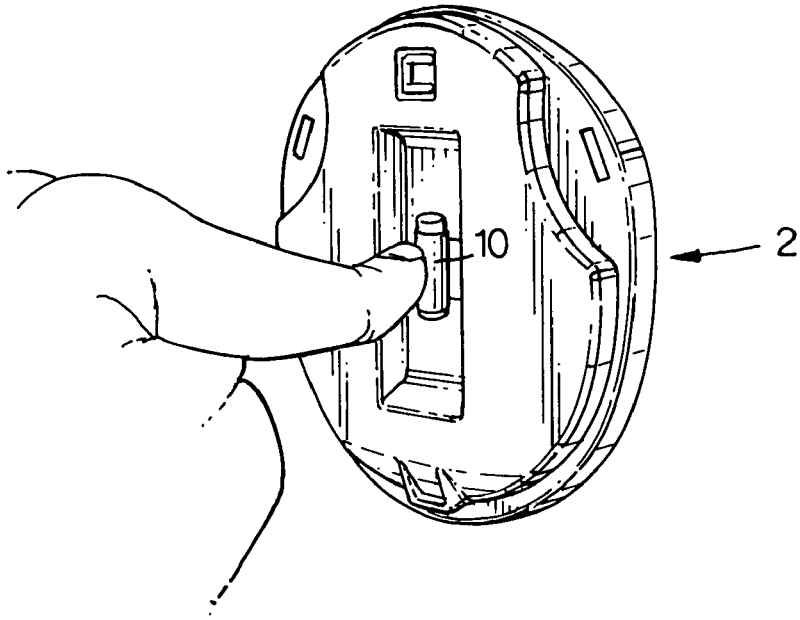
FIG. 5 shows the back plate being installed.

The lowermost (when upright as shown in FIGS. 1,2,3) of the apertures 32 has an inclined wall 40 to assist engagement of the corresponding projection 31. The remaining apertures 32,34 are simply rectangular through-holes. Thus, the device can be fitted firstly by inserting projection 33 into aperture 32 to locate reservoir 6 relative to support member 2, and then simply pressing the remaining projections simply squeezes at the top two lugs and pulls forward.

The projections include locking lugs 41, 42, 43 lock the projections 31,33,35, into the respective apertures 30,32,34. The lugs 41, 42, 43 are inclined radially inwards to facilitate smooth engagement.

Locking is improved by the projections 31,33,35 being biased radially outwards, toward a locking position with a respective projection 30,32,34, whereby relative resilience of the mounting of the projections 31,33,35 allows movement of the projections 31,33,35 for engagement/disengagement.

As shown more clearly in FIG. 3, the reservoir body 20 includes a chamber or inlet port 208, having a capacity to hold a predetermined volume of fluid freshener, which is, in this embodiment 1.5 ml and is sufficient for one drying cycle of 1 hour at 60 degrees C. However, the inlet port may have a volume sufficient for any number of cycles. The port 208 is located beneath (when the device is held oriented as it would be when attached to the dryer door) and in fluid communication with the reservoir recess 204 to allow liquid to enter the port 208 from the reservoir bottle 22 when it is in place in the recess 204.

Figure 6:
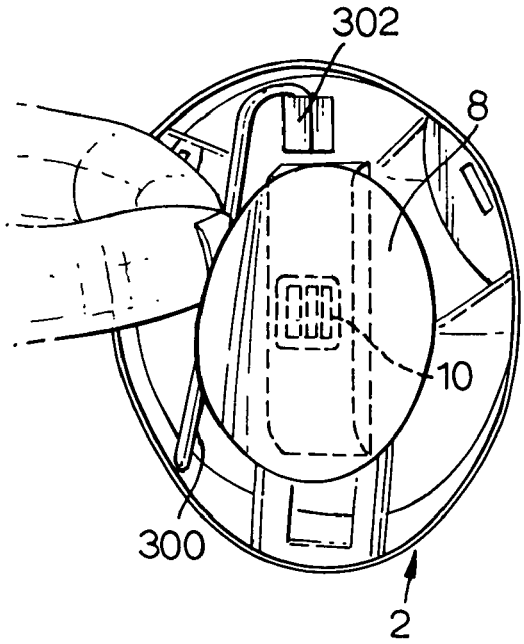
FIGS. 6 and 7 show the back plate from the rear.
Figure 7:
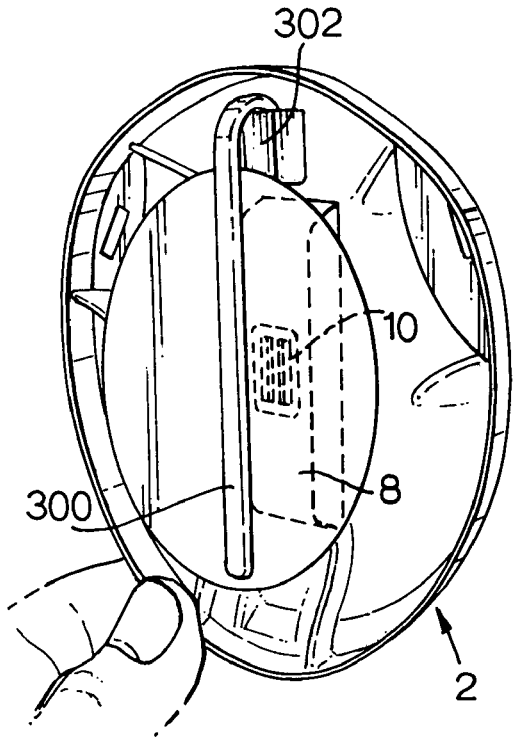

The rear of the device (shown in FIGS. 6 and 7) is recessed and also contains a hook 300 for supplemental attachment to the tumble dryer door of e.g. condenser dryers (which have slots or holes in the door or pitted surface). One possible hook shape is shown comprising an elongate arm which is pivotable about a pivot 302 through about 90 degrees, between a storage position in which the hook 300 is enclosed within the rear recess and an attachment position in which it projects from the device. The hook is curved only where it connects with the device—it is straight at the opposite end, as the gentle curve blocks the removal of the machine filter in some machines, so needs to be removed from the design for such machines.

As shown in FIGS. 4*a*-4*g*, the reservoir bottle 22 comprises a polypropylene bottle with body portion and neck portion 214. The body portion is defined by three main generally crescent shaped faces: a front face 222 and a rear face 224 and a shoulder face 226. The front and rear faces 222, 224, extend from opposed edges of the shoulder face 226 and depend therefrom to meet at a common curved edge 228. The radius of curvature of the rear face 224 is less than that of the front face 222.

The reservoir recess 204, has a curved back wall 230, base wall 232 and top wall or lip 234 which correspond in shape with the rear face 222 shoulder face 226 and edge 228 respectively so that the reservoir is retained in the recess by the walls 230,232 and 234 and by the retaining overhanging edges of 202 and by the engagement of the neck portion 214 with the port 208. The neck is configured for engagement with the inlet port 208, taking into account of any seals: The inlet port 208 may include an annular resilient seal 216 of a thermoplastic elastomer (TPE) to ensure leak proof engagement of the reservoir bottle 22 with the port 208.

The reservoir bottle 22 preferably has a pin-hole (not shown) in the edge region 228 or front face 222 or back surface 224 so that as fluid freshener leaves the bottle it can be replaced with air, gradually, so as not to interfere with the gradual flow of the fluid to the membrane. This has the advantage of ensuring consistency in delivery of composition.

Insertion and removal is aided by limited flexibility of the refill bottle 22 and reservoir body 20 such that snap-fit installation and removal can be effected easily.

The support member 2 is first attached to the tumble dryer interior, by applying direct force to the suction cup actuator 10. The reservoir 6 can then be attached (with reservoir bottle in place or without) as and when fabric treatment composition needs to be dispensed. When no fabric treatment is required, the reservoir 6 can be removed and the support member 2 left in place.

The device 1 may alternatively comprise a one piece generally rigid dome shaped body with a reservoir recess configured for snap-fit receipt of a removable reservoir. The reservoir recess constitutes a major part of the upper half of the body (when orientated upright).

The transfer means comprises two flow control members (not shown in detail but indicated at 300): an inner delicate but precise flow control member and an outer compressed foam layer. The inner flow control member is a polypropylene membrane with a thickness of 160 microns and a pore size of 0.2 microns. However other thickness/pore size values may be used, the appropriate pore size and thickness of the membrane varying depending on the fabric treatment composition viscosity, and the delivery rate required.

The compressed foam has a compression ratio (or 'firmness') of 8, having been compressed from an initial thickness of 42 mm to a compressed thickness of 6 mm. The foam has an (initial, i.e. pre-compression) pore size (PPI, pores per liner inch) of 80 ppi. The foam is compressed by heat and pressure to produce a permanent compression—no compression devices are needed.

The foam is a polyester foam the density of the foam material is 0.383 g/cm=kg/m (=23.9 pounds per cubic foot).

The foam and membrane are fixed around their perimeters preferably by ultrasonic welds and preferably, to enable a better seal (for the purpose of preventing leaking of the fabric treatment composition), by a substantially continuous weld, to a window frame 212.

Optionally, the inlet port 208, is integral with the window frame, again, to enable a leak proof system. The manufacture of the framed membrane involves melting upstanding ribs on the frame by ultrasonic welding so as to weld these to the perimeter of the membrane. The framed membrane is attached to the device body (by the ultrasonic welding which is done with the port/frame/membrane in situ in the device body).

The area inside of the welded perimeter provides the effective flow control area that is to say the active part of the flow control members.

In the embodiments shown in FIGS. 1 and 2, the area is 40×27 mm=1080 mm. Another embodiments (not shown) may have has larger area of 50×27 mm=1350 mm, or larger still, such as 80×30=2400 mm. Preferably the effective part of the transfer means has an area in the range 500-5000 mm.

Behind the members is a recess of corresponding shape which has a slightly projecting perimeter region for attachment of the frame thereto, so that a gap is defined between the inner member and the recess wall. In this narrow gap approximately 2-3 mm, a small amount of freshener fluid can collect to 'charge' or 'feed' the members continuously without causing leakages.

It is important to prevent leakage of the fabric treatment composition, as this can lead to staining of fabrics.

In use the reservoir is disposed with the neck pointing downwards, engaging the inlet port so that fluid from the reservoir flows, under gravity to the port and then to the members from where it evaporates/transfers in the dryer.

The fabric treatment composition may take any suitable form, for example it may be as described in any of the following embodiments (e.g. solid, liquid, gel at room temperature).

Suitable Fabric Treatment Compositions May be as Follows:

A. first fabric treatment composition, is defined as a heat activated fabric treatment composition comprising:
   (a) from 3 to 75 wt % of one or more fabric treatment active ingredients;
   (b) from 10 to 50 wt % of water;
   (c) from 5 to 40 wt % of an oil; and
   (d) optionally from 2 to 20 wt % of a nonionic surfactant.

Samples of this composition are represented by a number. Comparative samples are represented by a letter.

All values are % by weight of the active ingredient unless stated otherwise.

The samples in table 1 were prepared as follows:

The quat, oil and optional solvent were weighed in a beaker and heated on a hot plate until molten (about 70 C). Hot water (also about 70 C) was then slowly dosed into the molten mixture with stirring. To this mixture, perfume was added and stirring continued until a 'clear' liquid was produced. The liquid was bottled and left to cool either in the bottle or on a rotary blender.

TABLE 1

| | Sample | | | | | |
|---|---|---|---|---|---|---|
| | 1 | 2 | 3 | A | B | C |
| Quat (1)* | 50 | 50 | 50 | 80 | 50 | 50 |
| Sirius M85 (2) | 20 | 0 | 0 | 0 | 0 | 0 |
| NP-35 (3) | 0 | 20 | 0 | 0 | 0 | 0 |
| Estol 1545 (4) | 0 | 0 | 20 | 0 | 0 | 0 |
| DPG (5) | 5 | 5 | 5 | 10 | 0 | 5 |
| PEG 200 (6) | 0 | 0 | 0 | 0 | 25 | 0 |
| Glycerol | 0 | 0 | 0 | 0 | 0 | 20 |
| Perfume | 5 | 5 | 5 | 5 | 5 | 5 |
| Water | 20 | 20 | 20 | 5 | 20 | 20 |

(1) Stepantex VL85G (85%), tallow (IV about 35) based TEA quaternary ammonium material with 15% DPG solvent (ex Stepan)
(2) mineral oil, ex Fuchs
(3) mineral oil, ex Emca
(4) ester oil, ex Uniqema
(5) dipropylene glycol (ex Dow Chemicals). This was present in addition to any DPG present in the raw material of the quaternary ammonium material.
(6) polyethylene glycol 200, ex Clariant
For materials in table marked "*", the amount denotes the level of raw material present.

Further compositions were prepared according to the method described above.

TABLE 4

| | Sample | | | | | | |
|---|---|---|---|---|---|---|---|
| | 4 | 5 | 6 | 7 | 8 | D | E |
| Quat (1)* | 50 | 55 | 50 | 55 | 50 | 50 | 55 |
| DC 245 (2) | 25 | 20 | 0 | 0 | 0 | 0 | 0 |

TABLE 4-continued

| | Sample | | | | | | |
|---|---|---|---|---|---|---|---|
| | 4 | 5 | 6 | 7 | 8 | D | E |
| NP-35 (3) | 0 | 0 | 20 | 20 | 0 | 0 | 0 |
| Estol 1545 (4) | 0 | 0 | 0 | 0 | 20 | 0 | 0 |
| DPG (5) | 0 | 0 | 5 | 0 | 5 | 0 | 0 |
| DPnB (6) | 0 | 0 | 0 | 0 | 0 | 25 | 40 |
| Perfume | 5 | 5 | 5 | 5 | 5 | 5 | 5 |
| Water | 20 | 20 | 20 | 20 | 20 | 20 | 0 |

(1) Stepantex UL G80 (80%), hardened tallow (IV < 1) based TEA quaternary ammonium material with 20% DPG solvent (ex Stepan)
(2) Volatile silicone oil, ex Dow Chemicals
(3) mineral oil, ex Emca
(4) ester oil, ex Uniqema
(5) ester oil, ex Uniqema
(5) dipropylene glycol (ex Dow Chemicals). This was present in addition to any DPG present in the raw material of the quaternary ammonium material.
(6) dipropyl glycol n-butyl ether
*denotes the level of raw material present.

The following compositions were prepared by weighing the quat, oil, nonionic and optional solvent into a beaker and heating on a hot plate until molten (about 70 C). Hot water (also about 70 C) was then slowly dosed into the molten mixture with stirring. Perfume was added and stirring continued until a 'clear' liquid was produced. The liquid was left to cool either in a bottle or on a rotary blender.

TABLE 7

| | Sample | | | | |
|---|---|---|---|---|---|
| | 9 | 10 | 11 | 12 | 13 |
| Quat (1)* | 20 | 0 | 40 | 35 | 40 |
| Quat (2)* | 0 | 20 | 0 | 0 | 0 |
| Emnon SCR-PK (3) | 30 | 30 | 0 | 0 | 0 |
| Squalane 99% (4)* | 0 | 0 | 20 | 0 | 0 |
| Semtol 70/28 (5) | 0 | 0 | 0 | 15 | 0 |
| Sirius M40 (6) | 0 | 0 | 0 | 0 | 20 |
| Nonionic coco 11EO (ex Slovasol) | 20 | 20 | 5 | 10 | 5 |
| Dipropylene glycol | 5 | 5 | 0 | 0 | 0 |
| Water | 20 | 20 | 30 | 35 | 30 |
| Perfume | 5 | 5 | 5 | 5 | 5 |

(1) Stepantex ULG60 80% (DPG 20%) a hardened tallow TEA Quaternary ammonium material (IV < 1) (ex Stepan)
(2) Stepantex VL85G (85%) (15% DPG) a tallow TEA (IV < 1) quaternary ammonium material (ex Stepan)
(3) A sugar ester oil based on palm kernel (ex KAO)
(4) A natural oil (ex Aldrich)
(5) A white mineral oil (ex Goldschmidth)
(6) A white medicinal quality mineral oil (ex Silkolene)
*denotes the level of raw material present.

All above formulations produced microemulsions at the heating temperature of a tumble dryer.

An Alternative Composition B is Defined as a Heat Activated Fabric Treatment Composition Comprising (a) from 3 to 75 wt % of one or more fabric treatment active ingredients;
(b) from 5 to 50 wt % of a nonionic surfactant; and
(c) from 10 to 50 wt % of water.

Examples of this kind of composition are as follows:

The samples in table B1 were prepared as follows:

The quat, nonionic and optional solvent were weighed in a beaker and heated on a hot plate until molten (about 70 C). The molten mixture was then added with stirring to hot water (also about 70 C) to which optional components such as a polyelectrolyte or salt had already been added. To this mixture, perfume was added and stirring continued until a 'clear' liquid was produced. The liquid was bottled and left to cool either in the bottle or on a rotary blender.

TABLE B1

| | Sample | | | | | | | |
|---|---|---|---|---|---|---|---|---|
| | A | 1 | 2 | 3 | 4 | 5 | 6 | 7 |
| Quat (1)* | 80 | 10 | 20 | 0 | 0 | 0 | 0 | 0 |
| Quat (2)* | 0 | 0 | 0 | 40 | 40 | 40 | 30 | 10 |
| Quaternised triethylene amine (3) | 0 | 0 | 0 | 0 | 0 | 0 | 5 | 0 |
| Polyelectrolyte (4) | 0 | 0 | 0 | 0 | 0 | 0 | 0 | 16 |
| Nonionic surfactant (5) | 0 | 40 | 40 | 10 | 0 | 15 | 10 | 0 |
| Nonionic surfactant (6) | 0 | 0 | 0 | 0 | 15 | 0 | 0 | 33 |
| DPG (7) | 10 | 0 | 0 | 0 | 0 | 0 | 15 | 5 |
| Glycol hydroxy pthalyl hydroxy pthalate (8) | 0 | 0 | 0 | 15 | 10 | 0 | 0 | 0 |
| Water | 5 | 45 | 35 | 30 | 30 | 40 | 40 | 31 |
| Perfume | 5 | 5 | 5 | 5 | 5 | 5 | 5 | 5 |

(1) Stepantex VL85G (85%), tallow (IV~35) based TEA quaternary ammonium material with 15% DPG solvent (ex Stepan)
(2) Stepantex UL G60 80% (DPG 20%), hardened tallow (IV < 1) based TEA quaternary ammonium material with 20% DPG solvent (ex Stepan)
(3) TEA (ex Aldrich) fully quaternised with di-methyl sulphate
(4) Catiofast CS (30% solution), ex BASF
(5) Genapol C200 (coco alcohol 20EO) ex Clariant
(6) Slovasol 2411, (coco alcohol 11EO) ex Sloveca
(7) dipropylene glycol (ex Dow Chemicals). This was present in addition to any DPG present in the raw material of the quaternary ammonium material.
(8) Glycol HPHP, ex Eastham
For materials in table marked "*", the amount denotes the level of raw material present.

The viscosity of the samples was measured at a shear rate of 106 s using a Haake Rotoviscometer RV20 cup and bob NV1 at both ambient temperature and at the heating temperature of the tumble dryer.

The invention claimed is:

1. A device for treating fabrics in a tumble dryer comprising a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterised in that the transfer means comprises compressed foam having a compression ratio of 8 or more and an inner flow control member comprising a membrane, the compressed foam being downstream from the inner flow control member and functioning to reduce staining when contacting fabrics.

2. A device according to claim 1 wherein the compressed foam is in the form of one or more layers.

3. A device according to claim 1 wherein the foam is compressed prior to fitting in the device.

4. A device according to claim 1 wherein the compressed foam is a polyurethane foam.

5. A device according to claim 1 the compressed foam is a polyester foam.

6. A device according to claim 1 where the compression ratio is 10 or more.

7. A device according to claim 1 wherein the compression ratio is 12.

8. A device according to claim 1 wherein the compression ration is 14.

9. A device according to claim 1 wherein the initial (pre-compression) pore size of the foam is 120 or less.

10. A device according to claim 1 wherein the initial (pre-compression) pore size of the foam is 100 or less.

11. A device according to claim 1 wherein the initial (pre-compression) pore size of the foam is 80 or less.

12. A device according to claim 1 wherein the initial (pre-compression) pore size of the foam is 60 or less.

13. A method of treating fabrics in a tumble dryer during multiple tumble drying cycles comprising attaching a device according claim 1 to the inside of a tumble dryer door and carrying out a tumble drying process with fabrics inside the tumble dryer.

14. A method according to claim 13 in which the tumble drier is operated to achieve an elevated temperature of up to 100° C.

15. A kit comprising a device according to claim 1 in combination with a fabric treatment composition optionally provided in a reservoir for use with said device.

16. A device according to claim 1 wherein the inner flow control member is a polypropylene membrane.

* * * * *